US010584858B1

(12) United States Patent
Boulanger et al.

(10) Patent No.: US 10,584,858 B1
(45) Date of Patent: Mar. 10, 2020

(54) LIGHTING ARRANGEMENT

(71) Applicant: CP IP Holdings Limited, Central Hong Kong (CN)

(72) Inventors: Dave Boulanger, Hong Kong (CN); Maciej Nowakowski, West Vancouver (CA)

( * ) Notice: Subject to any disclaimer, the term of this patent is extended or adjusted under 35 U.S.C. 154(b) by 121 days.

(21) Appl. No.: 15/903,583

(22) Filed: Feb. 23, 2018

Related U.S. Application Data

(63) Continuation of application No. 15/712,482, filed on Sep. 22, 2017, now abandoned.

(60) Provisional application No. 62/401,099, filed on Sep. 28, 2016.

(51) Int. Cl.

| | |
|---|---|
| ***F21V 21/04*** | (2006.01) |
| ***F21V 15/01*** | (2006.01) |
| ***F21K 9/20*** | (2016.01) |
| ***F21V 19/00*** | (2006.01) |
| ***F21S 8/02*** | (2006.01) |

(52) U.S. Cl.
CPC ..... *F21V 21/04* (2013.01); *F21K 9/20* (2016.08); *F21S 8/026* (2013.01); *F21V 15/01* (2013.01); *F21V 19/0015* (2013.01)

(58) Field of Classification Search
CPC ..... F21V 21/04; F21V 15/01; F21V 19/0015; F21S 8/026; F21K 9/20
See application file for complete search history.

(56) References Cited

U.S. PATENT DOCUMENTS

| | | | | |
|---|---|---|---|---|
| 7,566,154 | B2 * | 7/2009 | Gloisten | F21V 29/70 362/545 |
| 8,602,601 | B2 * | 12/2013 | Khazi | F21S 8/026 362/249.02 |
| 8,864,340 | B2 * | 10/2014 | Holland | F21V 7/0066 362/294 |
| 9,151,477 | B2 * | 10/2015 | Pickard | F21V 21/088 |
| 9,182,096 | B2 | 11/2015 | Kinnune et al. | |
| 9,458,999 | B2 | 10/2016 | Van De Ven et al. | |
| 9,568,181 | B2 | 2/2017 | Boomgaarden et al. | |
| 9,772,099 | B2 * | 9/2017 | Boomgaarden | F21V 21/041 |
| 9,964,266 | B2 * | 5/2018 | Danesh | F21S 8/02 |
| 10,139,059 | B2 * | 11/2018 | Danesh | F21S 8/02 |
| 2010/0259919 | A1 * | 10/2010 | Khazi | F21S 8/026 362/84 |
| 2013/0051012 | A1 * | 2/2013 | Oehle | F21S 8/026 362/235 |

(Continued)

*Primary Examiner* — Tsion Tumebo
(74) *Attorney, Agent, or Firm* — Black, McCuskey, Souers & Arbaugh, LPA

(57) ABSTRACT

A lighting arrangement can include a housing assembly, a light emitter portion at least partially enclosed by the housing assembly, and a trim assembly selectively engageable with the housing assembly. The housing assembly can be selectively engageable with a junction box or a lighting can; can be substantially centered on an axis; and can include a casing with a lower tread surface, an upper riser surface, and an upper tread surface. The upper riser surface and the upper tread surface can be configured to be positioned in the box/can. The lower tread surface can be configured to contact a bottom surface of the box/can. The light emitter portion can include a plurality of LEDs, a first lens, and a reflector. The lens can be backlit by the LEDs. The trim assembly can have a greater diameter than the housing assembly.

8 Claims, 3 Drawing Sheets

(56) References Cited

U.S. PATENT DOCUMENTS

| | | | | |
|---|---|---|---|---|
| 2013/0294084 | A1* | 11/2013 | Kathawate | F21S 8/026 362/294 |
| 2014/0071679 | A1* | 3/2014 | Booth | F21V 29/2212 362/249.02 |
| 2015/0009676 | A1* | 1/2015 | Danesh | F21S 8/02 362/296.01 |
| 2015/0233556 | A1* | 8/2015 | Danesh | F21S 8/02 362/365 |
| 2016/0084491 | A1* | 3/2016 | Boomgaarden | F21V 21/041 362/267 |
| 2016/0348860 | A1* | 12/2016 | Bailey | F21S 8/024 |
| 2016/0348861 | A1* | 12/2016 | Bailey | F21S 8/026 |
| 2017/0138576 | A1* | 5/2017 | Peng | F21S 8/02 |
| 2017/0307143 | A1* | 10/2017 | Shah | F21K 9/68 |

* cited by examiner

LIGHTING ARRANGEMENT

CROSS-REFERENCE TO RELATED APPLICATION

This application claims the benefit of U.S. Provisional patent application Ser. No. 15/712,482 for a LIGHTING ARRANGEMENT, filed on 22 Sep. 2017, which is hereby incorporated by reference in its entirety. This application also claims the benefit of U.S. Provisional Patent Application Ser. No. 62/401,099 for a LIGHTING ARRANGEMENT, filed on 28 Sep. 2016, which is hereby incorporated by reference in its entirety.

BACKGROUND

1. Field

The present disclosure relates to lighting fixtures operable to emit light.

2. Description of Related Prior Art

U.S. Pat. No. 8,066,412 discloses a Luminaire quick mount universal bracket system and method. A luminaire system provides for mounting and accessing a light fixture housing without tools. A universal bracket is coupled to the junction box along the ceiling and engages with a top mounting plate affixed to the housing. One or more slide hooks appended to the universal bracket allows the top mounting plate to mount to the universal bracket, and a reinforced spring and locking spring keeps the light fixture housing in place, while preventing rattling between the universal bracket and the top-mounting plate. The housing can be removed from the electrical junction box through the use of a release button affixed to the housing. The button disengages the locking spring from the top mounting plate, thereby allowing the housing to swivel away from the universal bracket and junction box by way of a hanging hook. The hanging hook supports the housing when released from the universal bracket.

U.S. Pat. No. 8,696,158 discloses an LED universal recessed light fixture. A recessed LED ceiling light fixture kit for installation to a ceiling panel or plaster frame in residential homes or commercial buildings is disclosed. The kit includes an LED engine with at least one LED facing downward, an LED driver, and an annular shaped, finned heat sink that receives the LED driver therein and the LED underneath. The fixture includes a tubular-shaped can having an open bottom and a top engaging the heat sink. Detachable can retainer springs or threaded fasteners engage the can at its circumference, wherein the springs mount the can to the ceiling panel, or alternatively, the fasteners attach the can to the plaster frame. A trim ring is snapped onto the can at its open bottom, and an electrical junction box sits on top of the heat sink.

U.S. Publication No. 20150233556 discloses a COMPACT RECESSED LIGHTING ASSEMBLY. A compact recessed lighting system is provided. The recessed lighting system includes a light source module and a driver coupled to a unified casting and within a shared junction box. The junction box may be coupled to a set of hangar holders that are movably coupled to a corresponding set of hangar bars. The junction box, including the light source module and driver installed therein, may move both 1) along the hangar bars and 2) along an axis perpendicular to the hangar bars. Accordingly, the junction box may be moved to rest in preferred location between a set of joists or beams in a structure. By being configured such that the junction box, along with the light source module and driver, is coupled to a unified set of moveable elements that position the combined structure, the recessed lighting system eliminates the added bulk and size of traditional recessed lighting systems.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A lighting arrangement can be mountable to at least one of a junction box and a recessed lighting can and the lighting arrangement can include a housing assembly, a light emitter portion, and a trim assembly. The housing assembly can be selectively engageable with at least one of a junction box and a recessed lighting can. The housing assembly can be substantially centered on an axis. The housing assembly can include a casing with a step-profile having a lower tread surface and an upper riser surface and an upper tread surface. The upper tread surface can be the topmost surface of the housing assembly. The upper riser surface and the upper tread surface can be configured to be positioned in the at least one of a junction box and the recessed lighting can. The lower tread surface can be configured to contact a bottom surface of the at least one of a junction box and the recessed lighting can. The light emitter portion can be at least partially enclosed by the housing assembly. The light emitter portion can include a plurality of light emitting diodes and a first lens and a reflector. The lens can be backlit by the light emitting diodes. The light emitting diodes and the reflector can be positioned in a cavity defined by the housing assembly at least partially surrounded by the upper riser surface. The trim assembly can be selectively engageable with the housing assembly and can have a greater diameter than the housing assembly.

BRIEF DESCRIPTION OF THE DRAWINGS

The detailed description set forth below references the following drawings.

DETAILED DESCRIPTION

Figure 1:
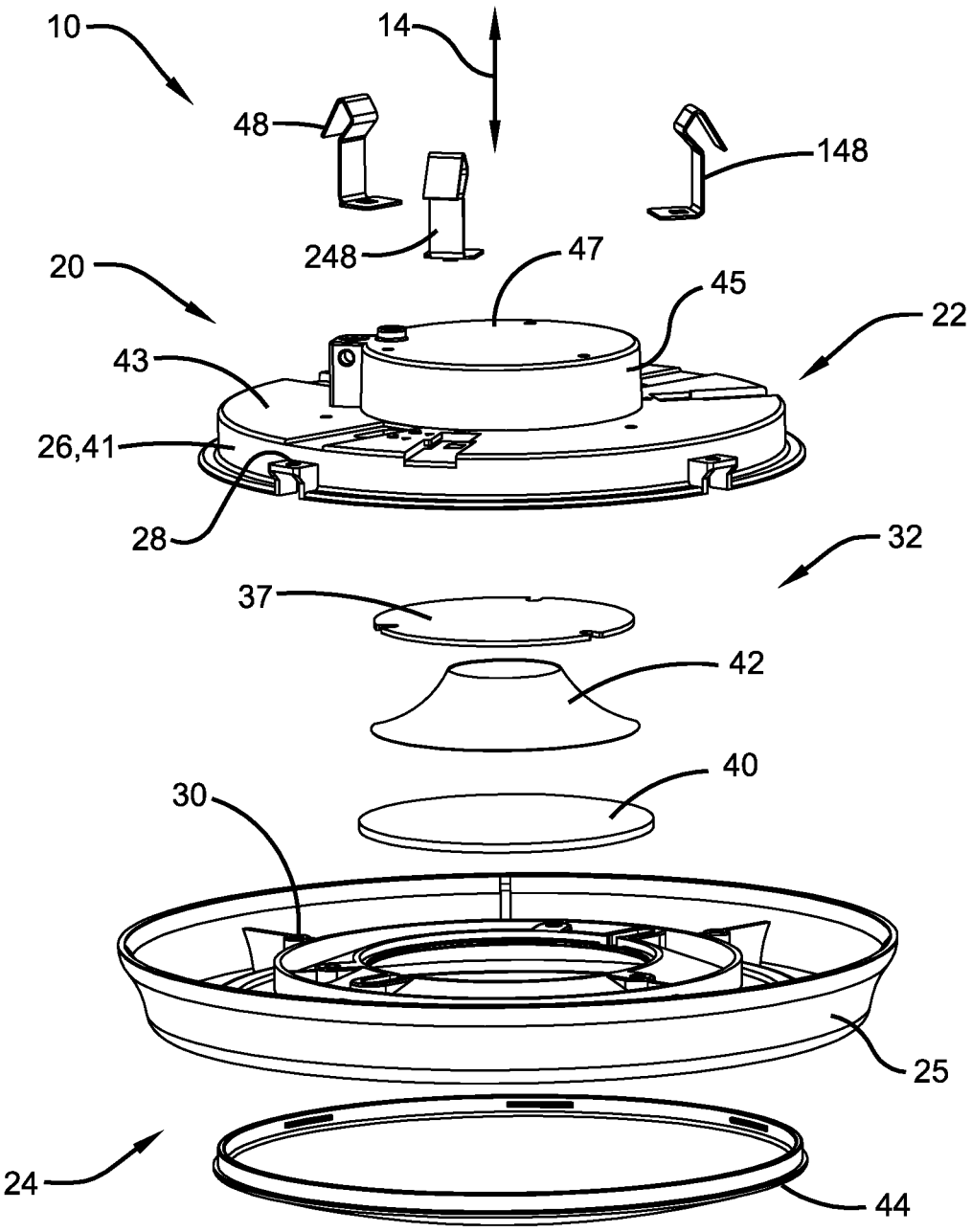
FIG. 1 is an exploded view of a lighting arrangement according to a first exemplary embodiment of the present disclosure.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

Figure 2:
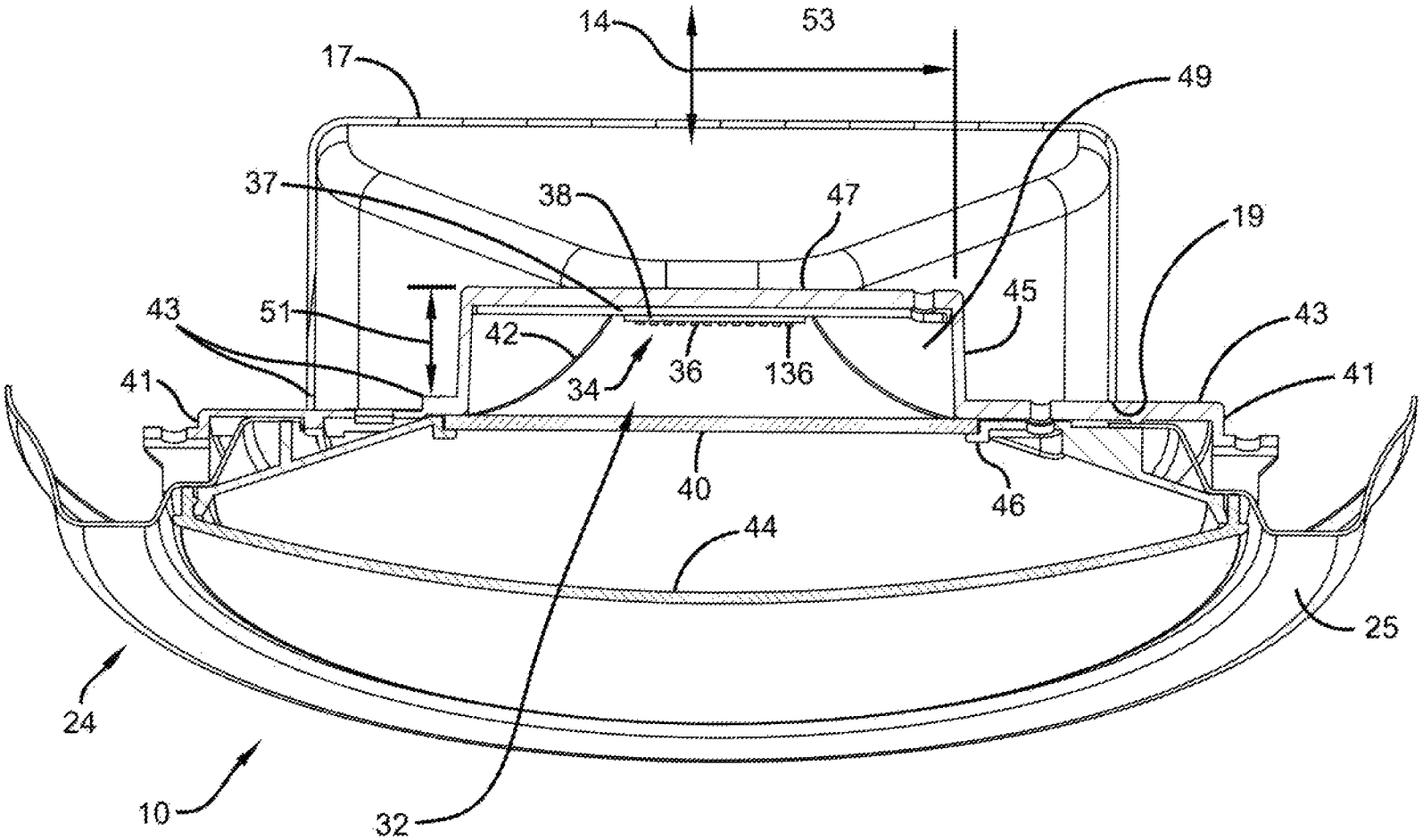
FIG. 2 is a cross-sectional and perspective view of the first exemplary embodiment mounted to a junction box.

FIGS. 1 and 2 illustrate a first embodiment of the present disclosure. An exemplary lighting arrangement 10 extends along and be centered on a central longitudinal axis 14. The exemplary lighting arrangement 10 is mounted to a junction box 17, referenced in FIG. 2. The junction box 17 can include a downwardly facing surface 19.

The exemplary lighting arrangement 10 includes a luminaire 20. The luminaire 20 can include a housing assembly 22. The housing assembly 22 can define a cavity. The housing assembly 22 can include a casing 26. The exemplary lighting arrangement 10 also includes a trim assembly 24 that is visible when the lighting arrangement 10 is mounted to a ceiling. The casing 26 can be positioned between the trim assembly 24 and the junction box 17. The trim assembly 24 and the casing 26 can be connected together with one or more fasteners. The fasteners can pass through apertures in the casing 26 such as aperture 28 and be received in bosses in the trim assembly 24, such as boss 30.

The trim assembly 24 can thus be selectively engageable with the housing assembly 22 and can have a greater diameter than the housing assembly 22, as shown best in FIG. 2. The exemplary trim assembly 24 includes a body 25 directly engageable with the housing assembly 22 and a diffuser 44.

The casing 26 can have the perimeter wall extending about the central longitudinal axis 14. The perimeter wall can take any desired shape, including square, circular, oval, rectangular, or any other shape. The exemplary casing 26 has a step-profile with a lower riser surface 41, a lower tread surface 43, an upper riser surface 45, and an upper tread surface 47. The lower tread surface 43 contacts and abuts the surface 19 of the junction box 17 when the lighting arrangement 10 is mounted for use. The upper tread surface 47 can minimally protrude above the surface 19. The upper tread surface 47 can be the topmost surface of the housing assembly 22. The upper riser surface 45 and the upper tread surface 47 are positioned in the junction box 17 when the lighting arrangement 10 is installed for use. In the exemplary embodiment, the upper tread surface 47 can protrude above the surface about 20 mm.

The luminaire 20 can also include a light emitter portion 32. The light emitter portion 32 can include driving circuitry 34 and light emitters, such as LEDs 36, 136. The driving circuitry 34 and LEDs 36, 136 can be mounted on a printed circuit board (PCB) 38. The PCB 38 can be mounted on a plate 37 and be positioned within the casing 26, above the lower tread surface 43. The LEDs 36, 136 can be directed generally along the axis 14. The lighting arrangement 10 can thus be back-lit.

The luminaire 32 can also include a lens 40 and a reflector 42. The lens 40 and the reflector 42 can be encircled by the casing 26 and can rest on a lip 46 defined by the body 25 of the trim assembly 24. The lens 40 and the diffuser 44 are supported in spaced relation to one another by the body 25. The lens 40 can be at least partially transparent and can be formed from glass or 5VA plastic. The reflector 42 can be funnel-shaped, encircling the PCB 38 at a top open end and resting on the lens 40 at an opposite and larger bottom end. The LEDs 36, 136 and the reflector 42 can be positioned in a cavity 49 defined by the housing assembly 22 at least partially surrounded by the upper riser surface 45. As shown in FIG. 2, the portion of the cavity 49 that defines an annular volume between the reflector 42 and the casing 26 is empty. FIG. 2 also shows that the LEDs 36, 136 are positioned closer to the upper tread surface 47 than the lower tread surface 43 whereby a shortest path of conductive heat transfer between the circuit board 38 and the upper tread surface 47 is shorter than a shortest path of conductive heat transfer between the circuit board 38 and the upper riser surface 45 and also shorter than a shortest path of conductive heat transfer between the circuit board 38 and the lower tread surface 43, whereby heat generated by the LEDs 36, 136 reaches the upper tread surface 47 before the lower tread surface 43 and the upper riser surface 45. The lens 40 is positioned outside of the cavity 49 surrounded by the upper riser surface 45. The lens 40 and the reflector 42 can enhance the distribution of light generated by the LEDs 36, 136. The diffuser 44 further enhances the distribution of light generated by the LEDs 36, 136. The diffuser 44 can be slightly deformed and snap into engagement with the trim assembly 24. The exemplary lens 40 is flat and the exemplary diffuser 44 is partially spherical.

The lighting arrangement 10 can also include spring arms 48, 148, 248 to interconnect the casing 26 and the junction box 17. The spring arms 48 can be affixed to the casing 26 with fasteners. In operation, wiring from the junction box can be interconnected with wiring from the driving circuitry 34. The luminaire 32 can then be raised so that the spring arms 48, 148, 248 are received in the junction box 17. Spring arms 48, 148, 248 are structured similarly and therefore the description of the spring arm 48 is applicable to the spring arms 148, 248. The distal ends of the spring arms 48, 148, 248 define barbs to engage the interior of the junction box 17. The spring arms 48, 148, 248 can be elastically deflected during insertion into the junction box 17 as the barbed, distal ends slide along the interior of the junction box 17. The spring arms 48, 148, 248 thus assert an outward force against the inside of the junction box 17. The force causes friction and prevents the luminaire 20 from falling out of the junction box 17. When the trim assembly 24 is in contact with the ceiling, insertion is complete. However, when desired, the user can selectively remove the lighting arrangement 10 from the junction box 17.

As shown in the drawings, the exemplary housing assembly 22 is finless. The distribution of heat can be accomplished without having fins on the housing assembly 22. Heat can be released through the casing 26 to the ceiling. As best shown in FIG. 2, the casing 26 defines several ratios which enhance the flow of heat away from the lighting arrangement 10. For example, the lower tread surface 43 has an outer diameter about the axis 14 (generally defined by the lower riser surface 41) and the upper riser surface 45 has a height 51 along the axis 14. The ratio of the outer diameter to the height 45 is greater than seven and in one more embodiments greater than nine. This results in the casing 26 minimally protruding into the junction box 17. The interior space of the junction box 17 is not consumed with the casing 26, allowing for greater air movement through the junction box 17.

Also, the upper riser surface 45 extends along a riser diameter about the axis 14. The radius of the upper riser surface 45 is referenced at 53. The outer diameter of the lower tread surface 43 is at least thirty-three percent larger than the riser diameter (twice the radius 53) and can be fifty percent larger in one more embodiments of the present disclosure. The percentage value was determined by subtracting the diameter of the upper riser surface 45 from the diameter of lower tread surface 43, and dividing that quantity by the diameter of lower tread surface 43. The ratio so described allows the casing 26 to extend laterally past the junction box 17 and interface with the ceiling. Heat can pass from the casing 26 and into the ceiling.

Figure 3:
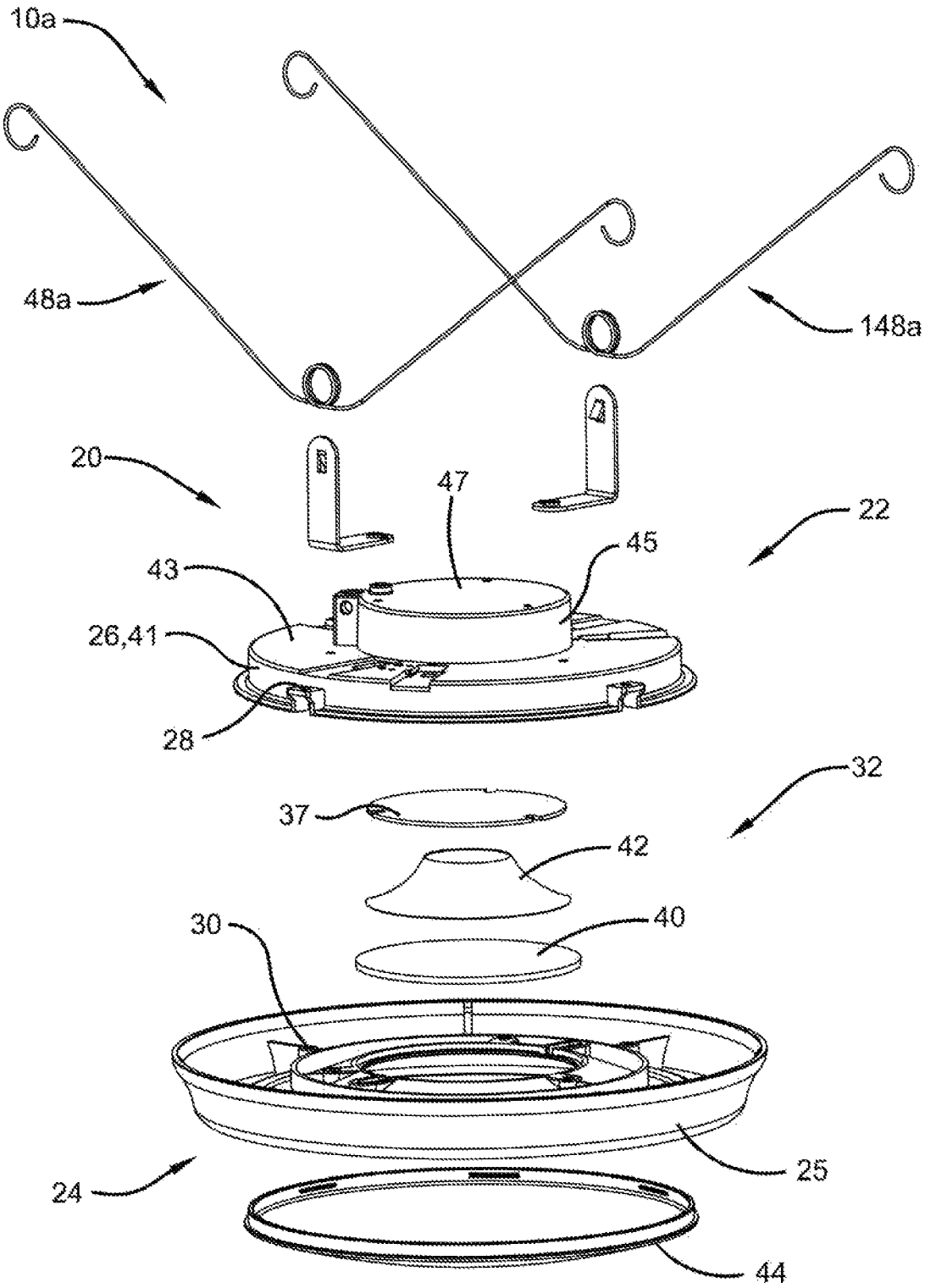
FIG. 3 is an exploded view of a lighting arrangement according to a second exemplary embodiment of the present disclosure.

FIG. 3 illustrates a second embodiment of the present disclosure. The lighting arrangements 10 and 10*a* includes numerous components in common and appropriate reference numbers have been retained. The lighting arrangement 10 is mountable in the junction box 17 and the lighting arrangement 10*a* is mountable in a recessed lighting can (not shown).

The lighting arrangement 10*a* includes a plurality of spring arms 48*a*, 148*a*. Each of the spring arms 48*a*, 148*a* defines a pair of distal ends that can elastically deform as the spring arms 48*a*, 148*a* slide along the interior of the can during insertion. When the lighting arrangement 10*a* is in contact with the ceiling, insertion is complete. The lighting arrangement 10*a* can then be rotated about the axis 14 as desired. The distal ends can frictionally engage the interior of the can to prevent the lighting arrangement 10*a* from dropping out of the can. When desired, the user can selectively remove the lighting arrangement 10*a* from the can.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved.

What is claimed is:

1. A lighting arrangement mountable to at least one of a junction box and a recessed lighting can, said lighting arrangement comprising:

a housing assembly selectively engageable with the at least one of the junction box and the recessed lighting can, said housing assembly substantially centered on an axis, said housing assembly includes a finless casing with a step-profile having a lower tread surface and an upper riser surface and an upper tread surface, said upper tread surface the topmost surface of said housing assembly, said upper riser surface and said upper tread surface configured to be positioned in the at least one of the junction box and the recessed lighting can, and said lower tread surface configured to contact a bottom surface of the at least one of the junction box and the recessed lighting can, and wherein said lower tread surface, said upper riser surface and said upper tread surface are defined by a unitary structure;

a light emitter portion at least partially enclosed by said housing assembly, said light emitter portion including a plurality of light emitting diodes and a first lens and a reflector, said lens backlit by said light emitting diodes, said light emitting diodes and said reflector positioned in a cavity defined by said housing assembly at least partially surrounded by said upper riser surface, said light emitting diodes mounted on a circuit board positioned closer to said upper tread surface than said lower tread surface, and wherein a shortest path of conductive heat transfer between said circuit board and said upper tread surface is shorter than a shortest path of conductive heat transfer between said circuit board and said upper riser surface and also shorter than a shortest path of conductive heat transfer between said circuit board and said lower tread surface whereby heat generated by said light emitting diodes reaches said upper tread surface before said lower tread surface and said upper riser surface;

wherein said casing is configured to extend away from said axis and laterally past the at least one of the junction box and the recessed lighting can and interface with the ceiling whereby heat generated by said light emitting diodes passes from said lower tread surface to ceiling;

wherein said lower tread surface has an outer diameter about said axis and said upper riser surface has a height along said axis and wherein a ratio of said outer diameter to said height is greater than seven whereby said upper tread surface is spaced from a downwardly-facing surface of the at least one of the junction box and the recessed lighting can;

a trim assembly selectively engageable with said housing assembly and having a greater diameter than said housing assembly; and wherein said casing is positioned between said trim assembly and the junction box.

2. The lighting arrangement of claim 1 wherein said lower tread surface has an outer diameter about said axis and said upper riser surface has a height along said axis and wherein a ratio of said outer diameter to said height is greater than nine.

3. The lighting arrangement of claim 1 wherein said lower tread surface has an outer diameter about said axis and said upper riser surface extends along a riser diameter about said axis and wherein said outer diameter is at least thirty-three percent larger than said riser diameter.

4. The lighting arrangement of claim 1 wherein said lower tread surface has an outer diameter about said axis and said upper riser surface extends along a riser diameter about said axis and wherein said outer diameter is at least fifty percent larger than said riser diameter.

5. The lighting arrangement of claim 1 wherein said reflector is funnel-shaped and wherein an annular volume defined between said reflector and said casing is empty.

6. The lighting arrangement of claim 1 wherein said trim assembly further comprises:

a body directly engageable with said housing assembly; and a diffuser wherein said lens and said diffuser are supported in spaced relation to one another by said body.

7. The lighting arrangement of claim 6 wherein said lens is positioned outside of said cavity surrounded by said upper riser surface.

8. The lighting arrangement of claim 6 wherein said lens is further defined as flat and said diffuser is further defined as partially spherical.

* * * * *